US005189388A

United States Patent [19]

Mosley et al.

[11] Patent Number: 5,189,388

[45] Date of Patent: Feb. 23, 1993

[54] OIL WELL PUMP START-UP ALARM

[76] Inventors: Judy A. Mosley, Rte. 1, Box 109, Ratliff City, Okla. 73081; Othal Ballard, 30 S Frances St., Healdton, Okla. 73438

[21] Appl. No.: 663,617

[22] Filed: Mar. 4, 1991

[51] Int. Cl.[5] ..... G08B 1/00

[52] U.S. Cl. ..... 340/309.15; 340/679; 361/29

[58] Field of Search ..... 340/309.15, 309.4, 309.5, 340/309.6, 679, 680; 307/141, 141.4; 361/29, 94, 95; 417/12; 181/103, 107

[56] References Cited

U.S. PATENT DOCUMENTS

| | | | |
|---|---|---|---|
| 1,709,517 | 4/1929 | Billingsley | 340/527 |
| 1,790,681 | 2/1931 | Smith | 340/654 X |
| 2,864,049 | 12/1958 | Sheets | 361/29 X |
| 3,191,114 | 6/1965 | Reed | 361/29 X |
| 3,334,272 | 8/1967 | Lipnitz | 361/95 X |
| 3,631,447 | 12/1971 | Sulat et al. | 340/679 X |
| 4,110,742 | 8/1978 | Hawkins | 340/309.4 X |
| 4,266,221 | 5/1981 | Hawkins | 340/679 |
| 4,297,678 | 10/1981 | Lee | 340/309.15 X |
| 4,821,024 | 4/1989 | Bayha | 340/309.15 X |

*Primary Examiner*—Jin F. Ng
*Assistant Examiner*—Brent A. Swarthout
*Attorney, Agent, or Firm*—Richard C. Litman

[57] ABSTRACT

A visual and audible alarm are connected to a control circuit for an oil well pumping unit. The control circuit includes a time clock which controls the intermittent ON-OFF cycle of operation of the pumping unit in the automatic mode, the OFF portion of the cycle allowing the well to recover pressure. The audible and visual alarm operates through a time delay relay connected to the time clock to provide a warning to people in the vicinity of the pump of the imminent start-up of the pump before allowing the pump to start, thereby providing people in the area the opportunity to avoid injury by evacuating the area.

8 Claims, 2 Drawing Sheets

OIL WELL PUMP START-UP ALARM

BACKGROUND OF THE INVENTION

1. Field of the Invention

This invention relates to a safety alarm cooperating with existing controls for oil well pumping units for the purpose of providing an audible and visual warning to people in the area of the pump that the pump is about to start operating. The safety alarm is connected to the existing time-clock in the control system and delays the start-up of the oil well pumping unit for approximately one minute while the audible and visual alarm is activated.

A large majority of the oil well pumping units in the U.S. operate on a time delay basis controlled by a time clock that will start and stop the oil well pumping unit at given time intervals. This intermittent operation increases the amount of oil pumped by allowing the well to recover pressure, but also causes a dangerous safety hazard. When the oil well pumping unit is in a dormant state, often people stand on or around the pumping unit, unaware that the pumping unit will restart at any moment, resulting in people being injured and even killed. Automatic start units have warning signs and sometimes fences in place, but these are not enough. Our invention includes a loud beeper, and if desired a light, on a sixty-second time delay relay which installs easily on the existing oil well pumping unit time clock. Before the oil well pumping unit can begin pumping, a loud one-minute warning signal is given, alerting workers and other people that the oil well pumping unit is about to begin pumping.

2. Description of Related Prior Art

Audible and visual alarms warning of a pending start of machinery are well known. U.S. Pat. No. 1,709,517 issued to Arthur E. Billingsley on Apr. 16, 1929 discloses control of both warning lights and normal lighting activated by a manual start-button to warn people of a pending start of machinery such as a printing press. Similarly, U.S. Pat. No. 1,790,681 issued to Hugh L. Smith on Feb. 3, 1931 discloses the use of a flasher relay to flash lights as a warning of pending operation of machinery such a printing press. Again, the alarm system is activated by operation of a manual start-button to initiate manual operation of the machinery. U.S. Pat. No. 4,266,221 issued May 5, 1981 to J.C. Hawkins discloses an alarm circuit which is interlocked with the start circuit of power-driven industrial machinery so that before the machinery can be started an alarm must be energized for a predetermined time to alert people that the machine is about to start. According to the Hawkins disclosure, in the event that the machinery is not started within a predetermined time after termination of the alarm, or in the event that the alarm has not actually sounded, the whole cycle must be repeated. U.S. Pat. No. 4,821,024 issued to Allan T. Bayha on Apr. 11, 1989 discloses an advance warning system for an automatic electric door operator in which a command signal originating from a remotely located hand-held radio transmitter or a wall switch located within the garage is received and processed by a signal receiver and transmitted to a signal delay unit. Upon receipt of the command signal, the delay unit activates a warning light and warning horn to alert people in the vicinity of the door or operator mechanism that the operator is about to be activated. After a predetermined delay period, the delay unit also generates an operating signal which activates the operator.

SUMMARY AND OBJECTS OF THE INVENTION

In each of the foregoing patents the alarm system is directly actuated by a manually activated start button, the alarm system being interposed in serial fashion between the start button and the machinery to be activated. In our device the alarm system, by contrast, is connected directly to a time clock responsive to either a manual or an automatic mode of operation whereby in the "automatic" mode an alarm is activated to warn people of the pending start of operation of the oil well pumping unit while the actual start of operation is delayed for a set period of time during operation of the alarm. In the "manual" mode of operation no alarm is needed because the person initiating the operation is present to see that it is safe to start the oil well pumping unit.

It is an object of the invention to provide an oil well pumping unit with a pre-start alarm system to warn people of a pending start-up of the oil well pumping unit.

It is a further object of the invention to provide an oil well pumping unit with a pre-start alarm system actuated during an "automatic" mode of operation but not during a "manual" mode of operation.

Other objects, features and advantages of this invention will become apparent from the following detailed description and the appended claims, reference being had to the accompanying drawings forming a part of the specification, wherein like reference numerals designate corresponding parts of the several views.

DETAILED DESCRIPTION OF THE PREFERRED EMBODIMENT

Before explaining in detail the present invention, it is to be understood that the invention is not limited in its application to the details of construction and arrangement of parts illustrated in the accompanying drawings, since the invention is capable of other embodiments and of being practiced or carried out in various ways. Also it is to be understood that the phraseology and terminology employed herein is for the purpose of description and not limitation.

Figure 1:
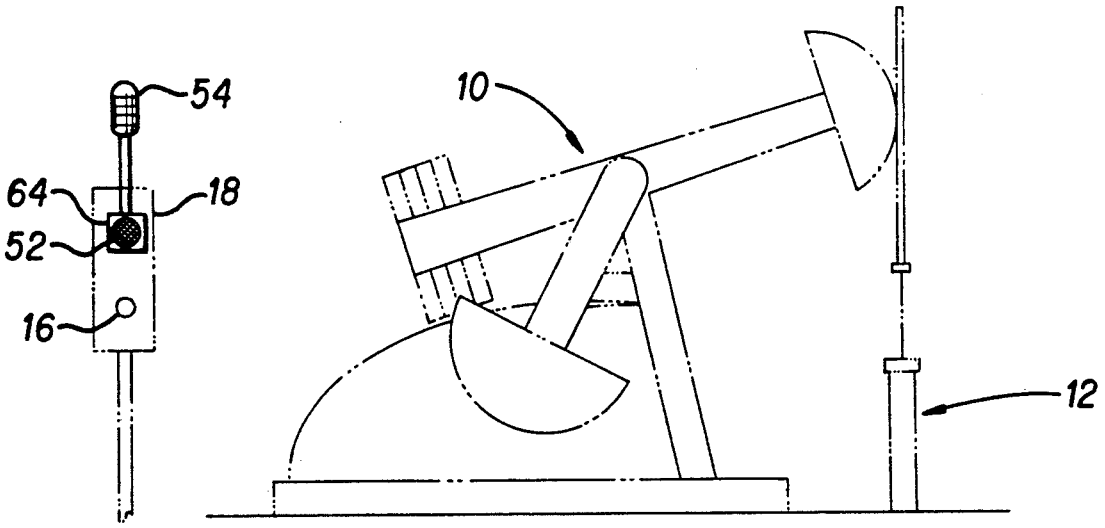
FIG. 1 is a view of an oil well pumping unit and control box therefor mounting an audible and visual alarm means.
Figure 2:
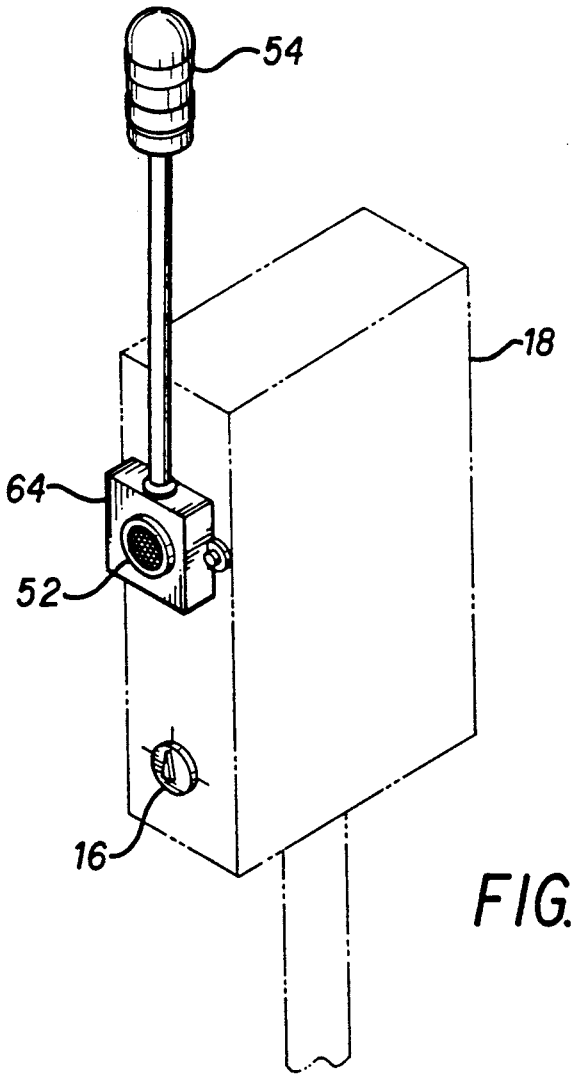
FIG. 2 is a perspective view of the control box showing the manner of mounting the alarm means thereon and the switch means shiftable between a manual "on", "off" and "automatic on" position.
Figure 3:
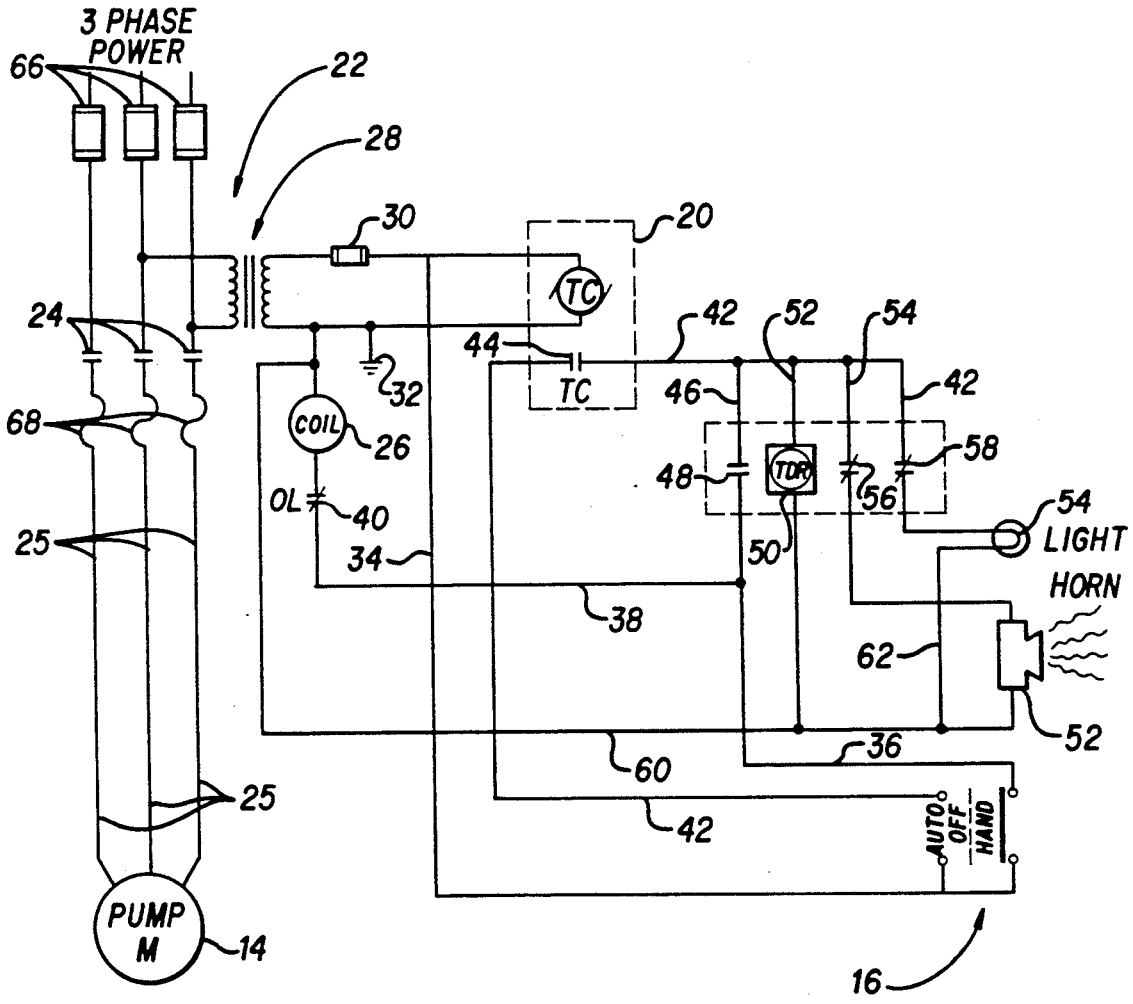
FIG. 3 is a view of the physical layout of the control circuitry including the alarm means.

Turning now to FIG. 1, there is shown a conventional oil well pumping unit generally identified by reference numeral 10, pumping oil from a well 12. Pumping unit 10 is driven by a three-phase motor 14 (see FIG. 3) normally in intermittent ON-OFF fashion under the control of a three-position switch 16. The intermittent operation is necessary to allow the well 12 to recover pressure after each pumping operation. The three-position switch 16 is connected to a control panel located in control box 18. From the OFF position, switch 16 can be moved to a "manual" or "hand" position or to an "automatic" position as indicated in FIG. 3. In the "manual" position the operator is at the pumping unit location and can see whether there is any reason for not starting the unit 10. Under those circumstances, there is no need for a warning signal.

Conventionally, pumps such as pumping unit 10 used to extract oil from the ground are normally unmanned and automatically operated by a time clock such as time clock 20 illustrated in FIG. 3. Three-phase power is provided to run pumping motor 14. Motor 14 is started, run and stopped by a conventional motor starter 22, using time clock 20 to close main contacts 24 in main power lines 25 through coil 26, to enable motor 14 to run. For safety and to provide the convenience of using a conventional time clock such as time clock 20, control circuit power is generally derived from a step-down transformer 28 within motor starter 22. This steps down the motor voltage, which may range from 200 V to 480 V nominal, to 120 V. To conform to National Electric Code requirements one side of transformer 28 is shown fused at 30 and the other side is shown grounded at 32. Time clock 20 is connected to run at all times. The hot (fused) side of the transformer output feeds ON-OFF-AUTO three-position selector switch 16 through line 34. In the "Hand" position shown in FIG. 3 the current continues through lines 36 and 38 and normally-closed contacts 40 to energize coil 26 which closes contacts 24, allowing the three-phase power to energize motor 14. The manual circuit bypasses time clock 20 which is not needed because the operator is on the scene at pumping unit 10. Coil 26 is conventionally located in motor starter 22.

In the prior art, when switch 16 is set to the "automatic" position, power flows through line 34, through switch 16, through line 42, through contacts 44 the opening and closing of which is controlled by time clock 20, through lines 46 and 38 and normally-closed contacts 40 to coil 26, to close the contacts 24 and operate motor 14 for a period of time controlled by time clock 20. Prior to our invention, normally-open contacts 48 were not present in line 46.

Although it is common practice to automatically operate unmanned pumping units such as pumping unit 10, a severe safety problem exists. Since the unmanned pumping units may be located in or near inhabited areas, they become attractive nuisances to passerbys, particularly children. The unexpected start-up of the pumping unit sets into motion much of the large structure of the pumping mechanism. Therefore, children playing on the pumping unit, and even experienced service personnel who may have forgotten to disable the pumping unit, may be injured or even killed upon start-up. This in fact occurs, and has triggered numerous lawsuits. To the best of our knowledge owners and operators of these pumping units have not solved the problem of preventing such injury prior to our invention.

The instant invention provides a means to warn those who are sufficiently close to the pumping units of imminent start-up, permitting these people to evacuate the area prior to the occurrence of a dangerous condition. An audible and visual alarm is provided which anticipates start-up. After a suitable time period which permits those present to evacuate the vicinity of the pumping unit, the alarms are extinguished. Pump operation, which had been inhibited by the alarm system, is then permitted.

This is done by incorporation within the electrical control system of pumping unit 10 of a time delay relay 50, an audible alarm 52 and a visual alarm 54.

Referring to FIG. 3 which incorporates our invention, when switch 16 is put in the "automatic" position, current flows through line 34, switch 16, and line 42 to normally-open contacts 44. After a suitable period of time determined by time clock 20, contacts 44 close, allowing current to continue traveling along line 42 to line 46 where it is blocked by normally-open contacts 48; current simultaneously flows to line 52 to start the operation of time delay relay 50, to line 54 and through normally-closed contacts 56 to activate audible alarm 52, and also through normally-closed contacts 58 to activate light 54. The current passes through light 54 to grounded line 60 through line 62. The current travels through grounded line 60 to ground at 32.

After a predetermined period of time has passed, time delay relay 50 is activated to change the status of contacts 48, 56 and 58, whereby current flows through lines 46 and 38 and now-closed contacts 48 to activate coil 26 to close contacts 24. Current through now-open contacts 56 and 58 is blocked, whereby light 54 and horn 52 are deactivated.

All of the components shown in FIG. 3 are located in control box 18 with the exception of motor 14, which is located in pumping unit 10, and the audible and visual alarms 52 and 54 which are located in a separate cabinet 64 suitably attached to control box 18.

Main power fuses 66 incidental to the invention are shown to provide conformity to National Electric Code requirements. Similarly, thermal overload protective elements 68 are shown directly below contacts 24. Normally-closed overload contacts 40 will open under the control of a conventional overload relay means 70 in the event of a motor overload condition. This feature is also incidental and required by the National Electric Code requirements.

While it will be apparent that the preferred embodiment of the invention herein disclosed is well calculated to fulfill the objects above-stated, it will be appreciated that the invention is susceptible to modification, variation and change without departing from the proper scope or fair meaning of the subjoined claims.

We claim:

1. An oil well pump start-up alarm comprising:

an oil well pumping unit;

control means for controlling the operation of said oil well pumping unit, said control means including an ON-OFF-Auto switch means in a motor control circuit means, a step-down transformer means for transferring power from main power lines to said motor control circuit means when said switch means is in one of ON and AUTO positions, and a time clock means for controlling an ON-OFF time sequence of said motor control circuit means when said switch means is in the AUTO position; and start-up alarm means connected to said motor control circuit means operable to provide an alarm prior to start-up of said oil well pumping unit; whereby people in the vicinity of the oil well pumping unit will be warned of imminent start-up of the oil well pumping unit.

2. An oil well pump start-up alarm as in claim 1, said alarm means comprising:

a time delay relay means connected to said time clock means;

a plurality of normally-closed contact means controlled by said time delay relay means, said normally-closed contact means being connected to an audible alarm means and a visual alarm means; and at least one normally-open contact means controlled by said time delay relay means, said open contact means blocking the flow of current to said oil well pumping unit during operation of said audible alarm means and said visual alarm means;

said time delay means reversing the status of said normally-closed contact means and said at least one normally-open contact means after a desired time delay; whereby said audible alarm means and said visual alarm means terminate their operation and power is provided to close main contacts between the main power lines and said oil well pumping unit to thereby operate said oil well pumping unit under the control of said time clock means.

3. An oil well pump start-up alarm as in claim 2, wherein:

said audible alarm means comprises a horn.

4. An oil well pump start-up alarm as in claim 2, wherein:

said visual alarm means comprises a light.

5. An oil well pump start-up alarm as in claim 2, wherein:

said audible alarm means comprises a horn; and said visual alarm means comprises a light.

6. An oil well pump start-up alarm comprising:

an oil well pumping unit means having a pump motor means;

normally-open main contact means in a power line to supply power to said pump motor means;

a motor starter means effective to close said main contact means;

a time clock means connected to said motor starter means to control start-up and shut-down of said pump motor means on an intermittent basis;

a time delay relay means connected to said time clock means to delay start-up of said pump motor means for a desired period of time;

alarm means connected to said time delay relay means for providing a warning of impending start-up of said pump motor means before said pump motor means is started; and three-way switch means for selectively operating said oil well pumping unit means in a manual mode and an automatic mode, said switch means being located in a motor control circuit means which includes said pump motor means, said main contact means, said motor starter means, said time clock means, said time delay relay means and said alarm means; whereby an alarm is provided to warn of impending operation of said oil well pumping unit means before said operation occurs.

7. An oil well pump start-up alarm as in claim 6, said motor starter means comprising:

a step-down transformer for stepping down voltage to operate said time clock means, said time delay relay means and said alarm means;

a coil means for operating said main contact means; and an overload relay means to open overload contacts in said motor starter means in the event of an overloaded circuit;

said three-way switch means controlling said motor starter means in both the manual mode and in the automatic mode.

8. An oil well pump start-up alarm as in claim 7, said alarm means comprising an audible alarm and a visual alarm operable in the automatic mode of operation of said oil well pumping unit means.

* * * * *